United States Patent [19]

Campbell

[11] 4,259,826

[45] Apr. 7, 1981

[54] CASE PACKING MACHINE

[75] Inventor: Barry D. Campbell, Spokane, Wash.

[73] Assignee: R. A. Pearson Co., Spokane, Wash.

[21] Appl. No.: 955,350

[22] Filed: Oct. 27, 1978

[51] Int. Cl.[2] ..... B65B 35/30; B65B 39/00

[52] U.S. Cl. ..... 53/543; 53/247; 53/248; 414/80

[58] Field of Search ..... 53/497, 143, 539, 543, 53/247, 248, 300, 142; 414/69, 80, 761, 762, 763; 294/87.22

[56] References Cited

U.S. PATENT DOCUMENTS

| | | | |
|---|---|---|---|
| 3,443,355 | 5/1969 | Birrell | 53/544 X |
| 3,452,508 | 7/1969 | Dzenis | 53/247 X |
| 3,864,890 | 2/1975 | Ullman | 53/247 X |
| 3,869,843 | 3/1975 | Darrah et al. | 53/247 X |
| 3,926,336 | 12/1975 | Graham et al. | 221/296 |
| 3,982,662 | 9/1976 | Graham | 221/296 |

*Primary Examiner*—Travis S. McGehee
*Attorney, Agent, or Firm*—Wells, St. John & Roberts

[57] ABSTRACT

A machine for placing groups of containers, preferably bottles, into cases. Successive groups of bottles are moved horizontally to a first station where they are releasably suspended on escapement bars. The bottles are suspended at enlarged neck flanges adjacent their finishes. A cam mechanism moves the bars apart to release bottles allowing them to be moved vertically downward to a second station. The bottles are releasably received within one of two horizontally movable chutes at the second station. The chutes are also pivotable relative to one another so that the bottles may be inverted piror to being loaded into a case at a case packing station below. The two chutes are reciprocated horizontally relative to the first station so one chute may be unloaded into an awaiting case while the remaining chute is being loaded through operation of the escapement mechanism. Each chute may be inverted as the chutes are horizontally reciprocated. Case loading mechanisms at opposite sides of the first station include plungers that move vertically downward through the chutes to engage and push the bottles into cases at separate case packing stations.

14 Claims, 7 Drawing Figures

50
58
59
49
54
52
53
55
48

45
17
40
70
41
42
24
28
44
26
68
25
33
27
18
32
34
35
11
23
24a
50
69
36
49
55
47
52
19
48
51
56
20

28
30
29
13
14
25
27
12
11
34a
32
34

28
30
40
25
29
27
34
34a
32
42
43
13
14
11

50
59
49
58
11
12
14
13
51

CASE PACKING MACHINE

BACKGROUND OF THE INVENTION

The present invention is concerned with a machine for packing groups of containers, preferably bottles, within open cases.

The present machine is designed to place a selected group of bottles within the confines of a shipping case or container for packing and shipping purposes.

Lightweight plastic disposable bottles for beverages or other fluids are currently becoming popular in the bottling industry. Such bottles are easily damaged in handling. The bottles are not easily packed horizontally into cases. It is more desirable to move the bottles vertically. This process has also been somewhat difficult because of the size and weight of the bottles. The lightweight bottles will not fall freely and predictably. It therefore becomes desirable to provide some form of case packing machine that will automatically load groups of such bottles vertically into cases while maintaining full control over the bottles.

It is often desirable to pack cases with bottles in inverted positions (open ends down) when there is chance that debris may fall into the otherwise open bottles. The disclosed machine will pack bottles automatically into cases and is selectively operable to invert groups of bottles prior to packing.

DETAILED DESCRIPTION OF A PREFERRED EMBODIMENT

Figure 1:
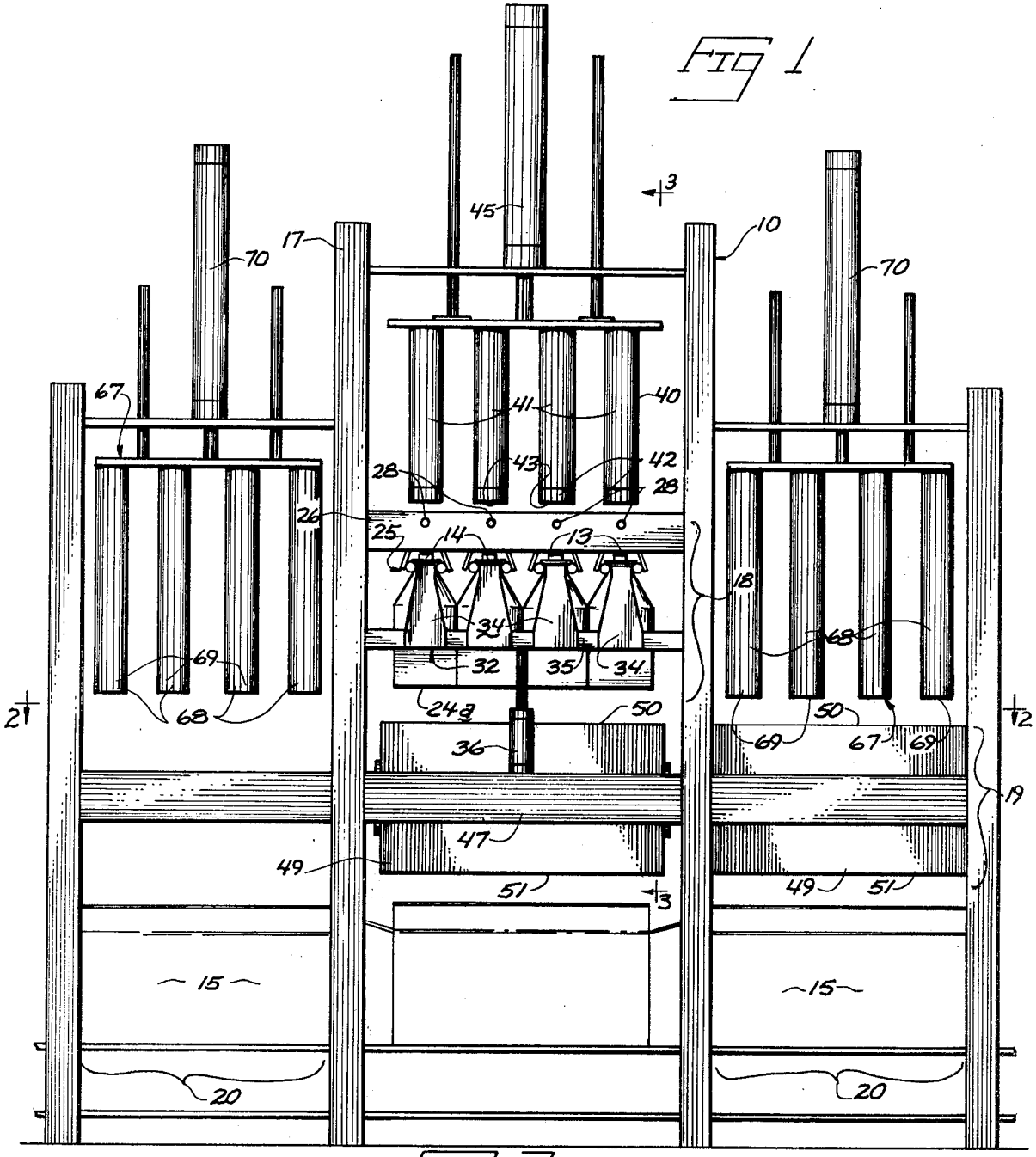
FIG. 1 is a front elevational view of the present case packer.

A case packer embodying a preferred form of the present invention is illustrated in the accompanying drawings and is generally designated by the reference character 10. The case packer 10 is designed to be utilized in the handling of empty or filled containers, especially bottles such as those diagrammatically illustrated at 11. Each bottle 11 includes a reduced neck 12 leading to a finish 13. An enlarged neck flange 14 is situated adjacent the finish 13. The bottles 11 are automatically collected in groups by the machine and placed into awaiting upwardly open cases 15 (FIG. 1).

The case packer 10 is supported by a general framework 17 which defines several work stations at which the different processes are performed for packing successive groups of bottles 11 into the cases 15. The stations are separated elevationally. The first station 18 initially receives bottles entering the machine. A second station 19 is situated elevationally below station 18. Bottles are transferred from the first station 18 to the second station 19 by operation of a ram means 40. In some instances, awaiting cases might be filled directly at the second station 19. The second station as illustrated is an intermediate station at which successive groups of bottles are shifted horizontally. Groups of bottles at the second station are guided downwardly to a case packing station 20 below. In instances where the first and second stations 18, 19 are arranged in a vertical fixed stack, only a single packing station 20 need be provided. The bottles entering the second station can be used to eject a prior group of bottles at the second station so as to move the group of bottles into a case at the packing station. Actually, two case packing stations 20 are provided below second station 19 and on opposite sides of the first station 18. The bottles are moved downwardly by plungers 68 from the second station 19 into cases 15 that are situated at the packing stations 20.

The following, more detailed description of the invention will be given in the arrangement of the stations briefly discussed above.

The First Station

Figure 3:
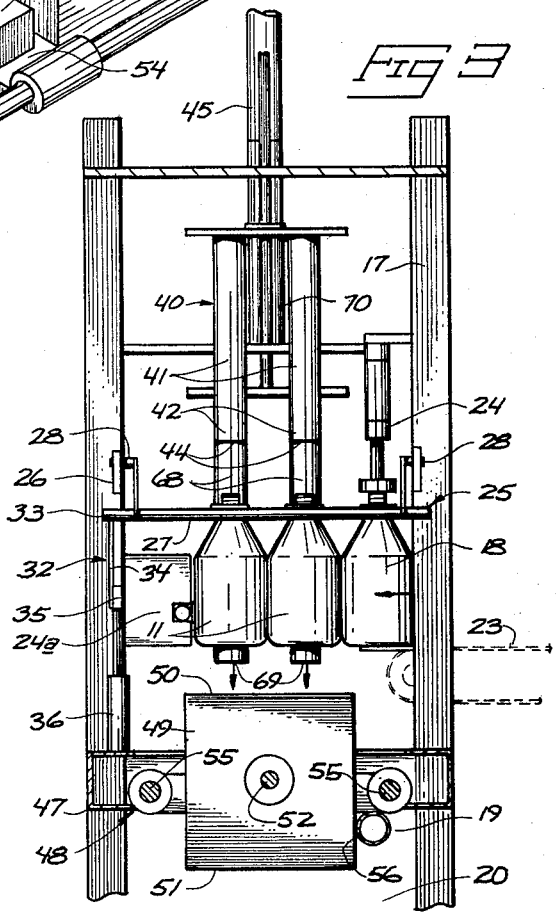
FIG. 3 is a sectional view taken along line 3—3 in FIG. 1.

Individual bottles are fed horizontally to the case packer 10 at the level of the first station 18. FIG. 3 illustrates a horizontal infeed conveyor 23 by dashed lines. The conveyor 23 may be any appropriate form of pallet type conveyor utilized for moving bottles horizontally. The working flights of such conveyors will slide beneath the bottles as they meet resistance to further motion. A bottle stop mechanism 24 may be provided on the frameworks 17 for this purpose. A stop and sensing mechanism **24*a* is provided to detect whether a selected number of bottles has been delivered to the first station 18. If so, the bottle stop and cylinder arrangement 24 may be operated to prevent further progress of the bottles on the infeed conveyor 23. The movable stop engages the upper surfaces of a row of bottles adjacent the first station 18 to hold further bottles on the conveyor 23 during transfer of the grouped bottles from first station 18 to second station 19. The stop mechanism 24 will automatically release to allow infeed of a subsequent group of bottles once the prior group has been shifted to the second station 19**.

Conveyor 23 feeds an escapement mechanism 25, situated at the first station 18 to alternately receive and release the successive groups of bottles. The escapement mechanism 25 is mounted along an escapement framework 26 that is an integral part of the general framework 17. Mechanism 25 includes at least one pair of elongated parallel escapement bars 27. Bars 27 extend horizontally from the infeed conveyor 23. Bottles are fed between the bars 27 by continuous pressure from the bottles on conveyor 23 and are engaged and supported at their enlarged shoulders 14.

Figure 5:
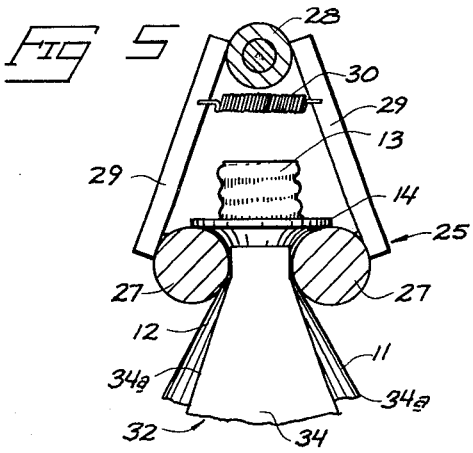
FIG. 5 is a fragmentary operational view.
Figure 6:
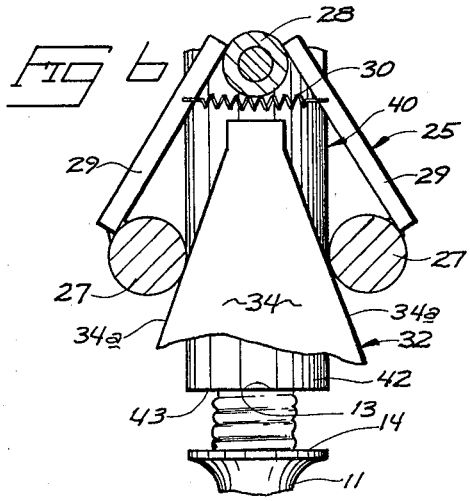
FIG. 6 is a view similar to FIG. 5 showing different operational positions of the elements therein.

A pivot 28 mounts the elongated escapement bars 27 for movement between a first position for receiving and suspending successive groups of bottles (FIG. 5) and a second position for releasing the successive groups (FIG. 6). Connecting members 29 extend between pivot 28 and escapement bars 27. Members 29 permit pivotal movement of the bars 27 about the horizontal axis of the pivot 28. A tension spring 30 is provided for each pair of connecting members 29. The springs interconnect the adjacent members 29 and therefore urge the escapement bars 27 toward their normal bottle-engaging positions (FIG. 5).

An actuating means is generally designated by numeral 32. Means 32 functions to selectively move the escapement bars 27 about the pivot axis between the two positions. Means 32 may include cam followers 33 mounted at outward ends of the bars 27 (FIG. 3). Cams 34 are positioned between the followers 33 and are moved in a vertical path to move the followers 33 between the first and second positions. Cams 34 may be mounted to a cam carriage 35 and moved by a jack means.

The jack means is comprised of a cylinder 36 that interconnects the carriage 35 and framework 17. It will therefore move the cams 34 elevationally relative to the cam followers 33. Opposed cam surfaces 34*a* are provided on each cam member 34 that are formed along lines that converge toward the axes of the pivots 28. The cam surfaces 34*a* form equal angles on opposite sides of central vertical planes through the vertical axes of containers held by the bars 27 and the axes of pivots 28. The cams move vertically to separate the paired bars against the resistance offered by springs 30 until the bars are separated by a distance greater than the width of the bottle neck flanges. The bars will move apart in unison and will simultaneously disengage, allowing the bottles to drop vertically.

A ram means 40 is provided to engage the bottles at the instant of their release from the escapement mechanism and to forcibly move the bottles downwardly to the second station 19. The ram means is generally designated at 40 and includes a plurality of vertically oriented plungers 41. A single plunger 41 is provided for each bottle of a group selected to be packed by the present machine.

Plungers 41 are substantially cylindrical. Each plunger includes a lower end 42 for engaging an individual bottle. The lower ends 42 are arranged along a horizontal plane. Each end 42 includes a horizontal bottom surface 43 (FIG. 6). The surfaces 43 are aligned with the mouths of bottles 11, that have been received and positioned on the escapement bars 27. The plungers 41 releasably receive and guide the bottles via surfaces 43 downwardly to the second station 19. A cylinder 45 is provided to move the plungers 41.

Appropriate conventional switching mechanisms may be provided operatively connecting the actuating mechanisms for cylinders 36 and 45 so the plungers 41 will be lowered to engage the bottles at the instant they are released by the escapement bars 27. The rate of descent for the plungers 41 is preferably greater than the free fall rate for a single empty bottle. This assures that control of the bottles will be maintained as they are moved from the elevation at first station 18 to the lower intermediate elevation at the second station 19.

The Second Station

As discussed above, the second station 19 is situated intermediate the first station and the case packing stations. Alternate groups of bottles received at the second station are laterally shifted to areas at each side of the first station. This lateral shifting movement may be accomplished after the cylinder 42 has returned to its normal illustrated position, as the escapement mechanism is receiving a group of bottles, and as the elements associated therewith are being readied to discharge the bottles to the second station.

A bottle chute means is provided at the second station 19 for receiving and guiding successive groups of bottles downwardly to the cases at the packing stations 20. The bottle chute means is movably mounted to a guide means for lateral movement to positions above the case packing stations 20. The guide means may include a supporting frame section 47 that is integral with the general framework 17.

The chute means includes first and second laterally spaced chutes 49. The chutes 49 are spaced so that one chute will be positioned directly below the first station 18 while the remaining chute 49 is positioned at a location overlying one of the case packing stations 20. One chute 49 can therefore receive a group of bottles while the bottles held by the remaining chute 49 are being discharged into a waiting case.

Figure 4:
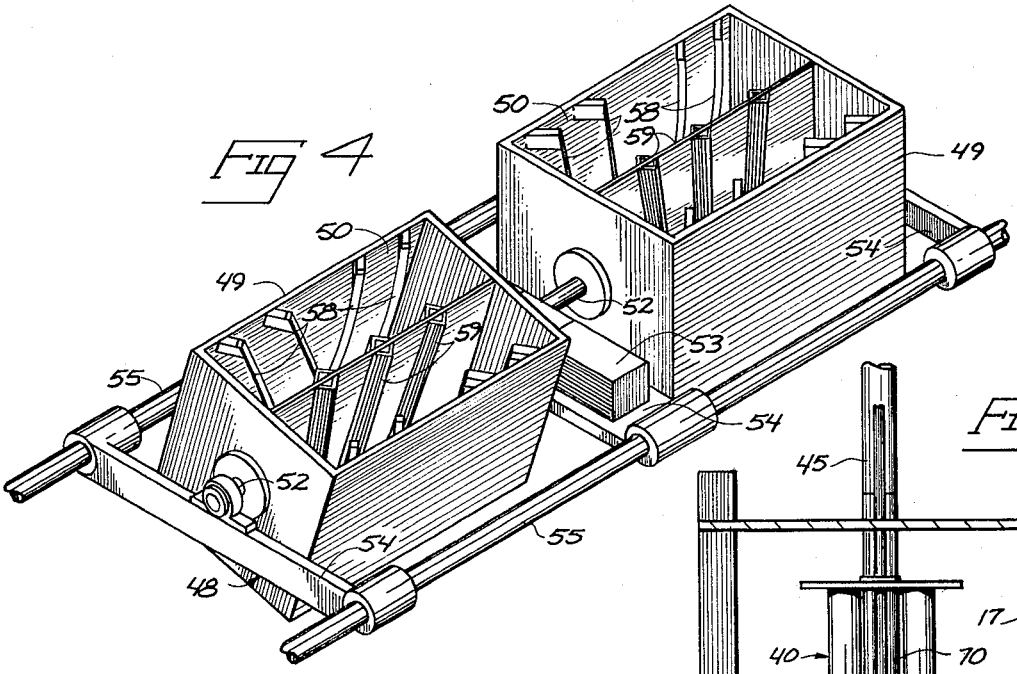
FIG. 4 is a fragmentary pictorial view of a portion of the present invention.
Figure 7:
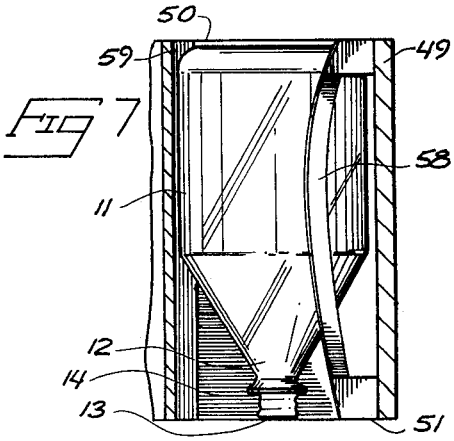
FIG. 7 is an enlarged fragmentary detail showing a bottle held in an inverted position.

The chutes 49, as shown in FIGS. 4 and 7, include open upper and lower ends 50 and 51. A bottle may therefore pass vertically through the chutes. Bottles are releasably retained as a group within the chutes by spring or solid biased guideways 58 and relatively stationary central guides 59.

The chutes 49 may be selectively inverted by a rotary actuator 53 on a slide frame 54. Preferably, each chute 49 is independently pivotable about a horizontal central axis along coaxial shafts 52. Separate actuators may be used for the two chutes 49 to permit one to be pivoted with respect to the other. Alternatively the chutes may be fixed relative to each other so both will pivot in unison.

When bottles are to be inverted during transfer to a case, one chute may be initially inverted or turned 180° relative to the other. Subsequent inversion of the chutes 49 in unison will then assure that one will be facing upward (under station 18) while the other is facing downward (above a case packing station 20). This inversion can be accomplished while the chutes 49 are being shifted across the machine.

The slide frame 54 carries the chutes 49 for reciprocating movement along a horizontal path between the case packing stations 20. The frame 54 is slidably carried by a pair of parallel guideways 55. Ways 55 are situated on opposite sides of the framework and are horizontal. They function as the guide means and define the path taken by the reciprocating chutes 49.

Figure 2:
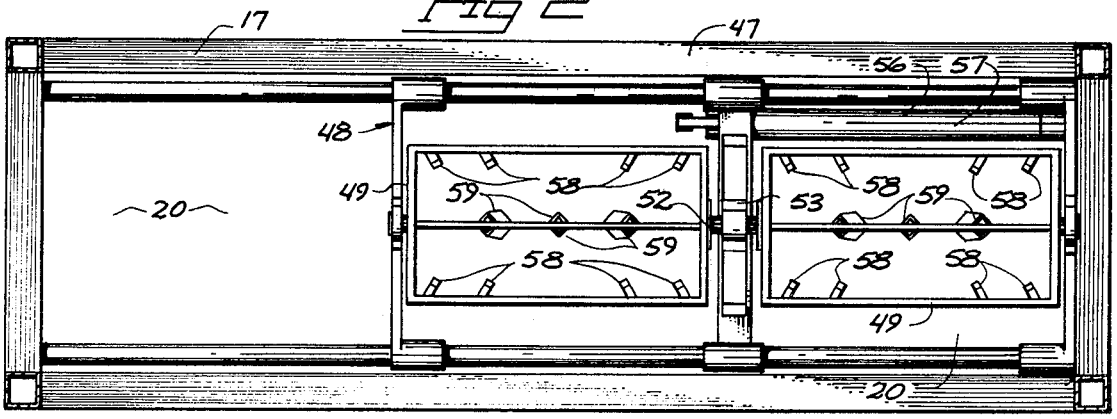
FIG. 2 is a sectional view taken along line 2—2 in FIG. 1.

Movement of the chutes 49 is controlled by a drive means 56. Means 56 may include a hydraulic or pneumatic cylinder 57 (FIG. 2) fixed between the framework 17 and slide frame 54. Extension and retraction of the cylinder will cause corresponding translational movement of the chutes 49. The length of stroke for the cylinder 57 is equal to the lateral spacing between either case packing station and the first station 18. Extension of cylinder 57 will thus bring one chute 49 to a location directly adjacent one of the case packing stations while the remaining chute 49 is directly below the first station 18.

The Case Packing Stations

As discussed above, there are two case packing stations spaced laterally from the first station 18. Successive groups of bottles are moved from the chutes 49 at each of the stations and deposited into cases 15. A loading means 67 is provided to move the bottles from releasable engagement within the receptacles 49 and into the cases 15.

The loading means 67 includes a plurality of loading plungers 68. Plungers 68 are similar to the plungers 41 of the ram means 40. The number of plungers 68 is equal to the number of bottles carried in a group. Each includes a lower end 69 for engaging a bottle. It should be noted that the plungers 68 will operate effectively whether engaging the bottles at the mouths 13 or whether they are utilized to press against the bottoms of inverted bottles as shown in FIG. 7. Plungers 68 are powered to move vertically by cylinders 70. Extension of a cylinder 70 brings the associated loading plungers 68 vertically downward through the aligned chute 49 to push the bottles from engagement with the guideways 58 and 59. The spring biased guideways 58 and stationary central guides 59 function to maintain the bottles in a tight rectangular pattern as they are being guided into a case 15.

Operation

A group of bottles is fed horizontally to the first station 18 by the horizontal infeed conveyor 23. The sensing mechanism 24*a* is utilized to determine that a specified number of bottles have been received by the escapement mechanism 25. The bottle stop assembly 24 is then actuated to halt further forward horizontal progress of bottles on the conveyor 23 for sufficient time to allow movement of the previously positioned group of bottles into one of the chutes 49.

The escapement mechanism 25 may be operated simultaneously with or slightly delayed from operation of the bottle stop mechanism 24. First, the actuating means 32 is operated to bring cams 34 upwardly into contact with the cam followers 33 on escapement bars 27. This forces the bars 27 apart until they release the enlarged neck flanges 14 of the group of bottles.

At the instant the bottles are released from the bars 27, the ram means 40 functions to bring the plungers 41 down into contact with the bottles to force the bottles downwardly to the second station 19 and a waiting chute 49.

The bottles are frictionally engaged within the chute between the spring biased guideways 58 and stationary central guides 59. This frictional engagement is sufficient to support the bottles during movement of the chute.

Retraction of the ram means 40 to its FIG. 1 position initiates, through suitable control devices, release of the bottle stop mechanism 24 and actuates cylinder 57 to shift the loaded chute to one or the other of the sets of loading plungers 68. The chute arriving at a position below the loading plunger 68 can be utilized to actuate the loading means 67. The plungers 67 will descend, engage the bottles, and force them downwardly from the chute 49 and into a case 15 waiting below.

The chute, after receiving a group of bottles from the escapement mechanism 25, may be pivoted 180° by the rotary actuator 53. Thus, the bottles will be inverted from their original positions and will be placed in the case 15 in an inverted position. The chute can be returned to its original position as it is reciprocated back to receive its next successive group of bottles.

By using two chutes and two case loading stations, greater case and bottle speeds are attained than in machines where bottles are moved in a straight line from an infeed conveyor to a case. This allows one chute to be filled at the same time that the other is being unloaded.

It should be noted that the above description and the attached drawings are given merely as examples to set forth a preferred form of the present invention. Only the following claims are to be taken as limitations upon the scope of this invention.

What is claimed is:

1. A case packer for automatically packing bottles into cases, each bottle having an enlarged neck flange adjacent the bottle finish, said case packer comprising:
   - a framework;
   - a first station on the framework;
   - a second station on the framework;
   - bottle escapement means at the first station for receiving a group of bottles and for locating the individual bottles within the group relative to said framework by individual engagement of the enlarged neck flange of each bottle and for selectively releasing the bottles as a group by disengagement of their enlarged neck flanges;
   - and bottle ram means adjacent the first station for engaging and moving a group of bottles from the first station to the second station as the group of bottles is released by the bottle escapement means.

2. The case packer as set out in claim 1 wherein the escapement means comprises:
   - at least one pair of elongated parallel escapement bars;
   - means mounting each pair of escapement bars to the framework for movement relative to one another between (a) a first position wherein the pair of bars are spaced apart a distance adequate to slidably receive individual bottles immediately beneath their enlarged neck flanges and to suspend the individual bottles from their enlarged neck flanges in a preselected group formation and (b) a second position wherein each pair of bars is spaced apart a distance greater than the neck flanges width to release the bottles as a group;
   - and actuating means for moving the bars between their first and second positions.

3. The case packer as defined by claim 1 wherein the bottle ram means includes a plunger for each bottle of a group held at the first station on the framework by said bottle escapement means;
   - each plunger comprising a bottle engaging lower end having a recess therein adapted to engage the finish of an individual bottle.

4. A case packer for automatically packing bottles into cases, each bottle having an enlarged neck flange adjacent the bottle finish, said case packer comprising:
   - an upright supportive framework;
   - a first station on the framework;
   - a second station on the framework and elevationally located below the elevation of said first station;
   - a case packing station on the framework and located elevationally below the elevation of said second station;
   - bottle escapement means at the first station for receiving a group of upright bottles and for vertically suspending the individual bottles by engagement of them beneath their respective enlarged neck flanges and for releasing the bottles as a group by disengagement of the enlarged neck flanges thereof;
   - bottle ram means on said framework at a location above the first station for engaging and moving a group of bottles downwardly from the first station to the second station as the group of bottles is released by the escapement means;
   - and chute means at the second station for receiving a group of bottles from the ram means and for guiding the bottles downwardly to the case packing station.

5. The case packer as set out in claim 4 wherein the escapement means comprises:
   - at least one pair of elongated parallel escapement bars;
   - means mounting each pair of escapement bars to the framework for movement relative to one another between (a) a first position wherein the pair of bars are spaced apart a distance adequate to slidably receive individual bottles immediately beneath their enlarged neck flanges and to suspend the individual bottles from their enlarged neck flanges in a preselected group formation, and (b) a second position wherein each pair of bars is spaced apart a distance greater than the neck flange width to release the bottles as a group;

and actuating means for moving the bars between their first and second positions.

6. The case packer as defined by claim 4 wherein the bottle ram means includes a plunger for each bottle of a group held at the first station on the framework by said bottle escapement means;

each plunger comprising a bottle engaging lower end adapted to engage the finish of an individual bottle.

7. The case packer as set out in claim 4 wherein there are two case packing stations at opposite sides of the first station and wherein the chute means includes a rotatable shuttle carriage which is comprised of first and second container chutes each adapted to receive and grasp a group of containers, said chutes each having upper and lower horizontal open ends for receiving or discharging bottles;

guide means mounting said container chutes to said framework for conjoint horizontal movement between two alternate positions relative to said framework;

drive means operably connected to said guide means for selectively moving said chutes between said alternate positions thereof;

and rotary actuator means for pivoting said chutes relative to said guide means for selectively inverting the chutes and any group of containers therein.

8. A case packer as set out in claim 7 wherein the first and second container chutes each include spring biased guideways for supporting groups of bottles in a rectangular pattern and for maintaining the pattern of the bottles within a chute as it is moved relative to said framework.

9. The case packer as set out in claim 4 wherein said chute means is horizontally movable on the framework and is reciprocated between two case packing stations at opposite sides of said first station;

and individual loading means above each case packing station for engaging bottles within said chute means and moving them through the chute means to the respective case packing stations.

10. The case packer as set out in claim 9 wherein said loading means is comprised of a group of plungers above each of said case packing stations, the number of plungers in each group being equal to the number of bottles in each group of bottles within said chute means, said plungers being vertically movable as a group for engaging a group of bottles within said chute means and for moving the engaged group of bottles downwardly through said chute means to the packing station beneath it.

11. The case packer as set out in claim 4 further comprising:

loading means for engaging bottles at the second station and for moving them downward through the chute means to the case packing station below it.

12. An escapement mechanism for successively receiving and releasing groups of bottles, each bottle having an enlarged neck flange adjacent a bottle finish comprising:

a framework;

at least one pair of elongated parallel escapement bars;

means mounting each pair of escapement bars to the framework for movement relative to one another between (a) a first position wherein the pair of bars are spaced apart a distance adequate to slidably receive and suspend individual bottles from their enlarged neck flanges in a preselected group formation and (b) a second position wherein the pair of bars are spaced apart a distance greater than the neck flange width to release the bottles as a group;

actuating means for moving the bars between their first and second positions; and conveyor means on said framework for sliding suspended bottles between the paired escapement bars while the bars are in their first position.

13. The escapement mechanism as defined by claim 12 wherein said means mounting the escapement bars to the framework is comprised of:

a pivot on the framework, the axis of which is parallel to the escapement bars;

rigid connecting members extending from the pivot to the escapement bars, mounting the bars to the pivot for movement between the first and second positions about the axis of the pivot;

a spring extending between the connecting members for urging the escapement bars toward each other;

cam followers on the escapement bars; and wherein the actuating means includes a cam movable between the cam followers to pivot the escapement bars between the first and second positions.

14. The escapement mechanism as defined by claim 13 further comprising power means operatively connecting the cam and framework for moving the cam to selectively engage and move the cam followers and thereby shift the escapement bars between the first and second positions.

* * * * *